US005545008A

United States Patent [19]

Guelich

[11] Patent Number: 5,545,008

[45] Date of Patent: Aug. 13, 1996

[54] METHOD AND APPARATUS FOR CONVEYING A FLUID

[75] Inventor: Johann Guelich, Winterthur, Switzerland

[73] Assignee: Sulzer Pumpen AG, Winterthur, Switzerland

[21] Appl. No.: 417,289

[22] Filed: Apr. 5, 1995

[30] Foreign Application Priority Data

Apr. 25, 1994 [EP] European Pat. Off. ..... 94810225.6

[51] Int. Cl.[6] ..... F04D 29/44

[52] U.S. Cl. ..... 415/206; 415/914

[58] Field of Search ..... 415/203, 206, 415/914; 416/231 R

[56] References Cited

U.S. PATENT DOCUMENTS

| | | | |
|---|---|---|---|
| 4,793,771 | 12/1988 | Laing | 415/206 |
| 4,844,692 | 7/1989 | Minkkinen et al. | 415/914 |
| 4,872,809 | 10/1989 | Addie et al. | 415/206 |
| 4,930,979 | 6/1990 | Fisher et al. | 415/206 |
| 5,224,823 | 7/1993 | Cordts | 415/206 |
| 5,246,335 | 9/1993 | Mitsubori et al. | 415/914 |

FOREIGN PATENT DOCUMENTS 0348674 1/1990 European Pat. Off. .

2202585 9/1988 United Kingdom .

OTHER PUBLICATIONS

Database WPI, Week 9029, Derwent Publications Ltd., London GB; AN 90-222680 & SU-A-1 513 224 (Ankudinov) Oct. 7, 1989.

Patent Abstracts of Japan, vol. 11, No. 388 (M-652) Dec. 18, 1987 & JP- A-62 157 297 (Mitsubishi) Jul. 13, 1987, Summary.

Patent Abstracts of Japan, vol. 6, No. 220 (M-169) Nov. 5, 1982 & JP-A-57 124 098 (EBARA) Aug. 2, 1982, Summary.

*Primary Examiner*—John T. Kwon

*Attorney, Agent, or Firm*—Townsend and Townsend and Crew

[57] ABSTRACT

A centrifugal pump (10) conveys a fluid from a rotor wheel inlet opening (8) via a rotor wheel outlet opening (9) into a pressure nozzle (4). The fluid has a velocity profile between the outer flow line (c) and the inner flow line (d). The method allows a fluid to be conveyed with a centrifugal pump (10) in such a manner that the velocity profile is continuously changed in dependence on the delivery flow (Q) which means that an abrupt change of the velocity profile when transferring from one load condition, e.g. at maximum efficiency, to another load condition, e.g. a partially loaded region, is avoided which results in a stable H/Q)-characteristic.

18 Claims, 5 Drawing Sheets

METHOD AND APPARATUS FOR CONVEYING A FLUID

BACKGROUND OF THE INVENTION

The invention relates to a method for conveying a fluid and an apparatus, in particular a centrifugal pump, for conveying a fluid in accordance with the method of the invention.

A centrifugal pump is a conveyor machine in which mechanical energy is transmitted to a liquid with a rotating rotor wheel. The energy of motion is converted into pressure energy partly in the rotor wheel and partly in the subsequent guide apparatus. Depending on the angle of outlet of the fluid, a distinction is drawn between radial, half-axial and axial rotor wheels. Centrifugal pumps are built as single stage pumps or multistage pumps (with stacked rotor wheels arranged in series) and also as single flow or multiflow pumps (with parallel arrangements of the rotor wheels). The throughflow or delivery can be regulated by restricting the flow in the pressure line, by changing the rotational speed or, in the case of axial and half-axial rotor wheels, via adjustment of the :rotor blades. In single stage centrifugal pumps for larger conveying flows, pre-twist regulation is used by generating a twist with an upstream adjustable guide wheel.

The operational behavior of centrifugal pumps can be described by characteristic lines or curves as a function of the delivery flow Q. For example, the pressure head H can be described in terms of a H(Q)-curve. When the H(Q)-curve falls steadily as a function of the delivery flow Q, it is termed a stable characteristic. If the H(Q)-line has a positive gradient in the curve, this is termed an unstable characteristic. When operating the pump with an unstable characteristic, it is for example possible that a full-load region is not reached because, under some circumstances, the pump cannot be operated in the unstable region when being run up to speed. Moreover, it may be impossible to operate pumps with unstable characteristics in parallel. Furthermore,.flow dependent pulses can occur in an unstable region of the characteristic. The causes of an unstable characteristic are complex flow phenomena in the centrifugal pump.

SUMMARY OF THE INVENTION

It is an object of the present invention to provide method for conveying a fluid so that the operational behavior of a centrifugal pump is improved, in particular in partial part load operation, by constructing rotational pumps in a manner which prevents unstable operating characteristics..

The advantages of the present invention are that a centrifugal pump with the features of the invention has a stable H(Q)-curve. Consequently, a stable operation of the centrifugal pump is achieved, in particular in the partial load region.

A centrifugal pump can comprise a closed, half-open or open rotor wheel. A rotor wheel comprises at least one blade and one carrier disc. A closed rotor wheel additionally comprises a cover disc. A fluid conveyed through the rotor wheel of the centrifugal pump flows through the centrifugal pump while forming a flow or velocity profile. The flow profile at the rotor wheel outlet strongly influences the pressure recovery in the guide apparatus (diffusor) and thus also the overall delivery head, particularly in part load operation. An unstable H(Q)-characteristic arises in a centrifugal pump due to the fact that the velocity profile does not smoothly change as the delivery flow Q changes, but rather changes abruptly or suddenly. A change of the velocity profile in dependence on the delivery flow Q arises since, in the region of maximum efficiency of the centrifugal pump, the flow for the most part hugs to or follows the rotor wheel and guide apparatus, whereas, in the intermediate part load region, flow separations occur in the rotor wheel and guide apparatus, and in that fully developed recirculation zones are present when the slider is shut both at the rotor wheel inlet and outlet.

An advantage of the present invention is that the velocity profile is continuously changed in dependence on the delivery flow so that a sudden change in the velocity profile on a transition from one load state (e.g. the maximum efficiency position) to another load state (e.g. a part load region) is avoided. A stable characteristic can for instance be achieved by ensuring that a recirculation zone at the rotor wheel outlet cannot jump from the carrier disc to the cover disc. In accordance with the method of the invention, a centrifugal pump can be designed in such a way that the velocity profile changes continuously in dependence on the conveying flow from the design delivery flow to zero delivery flow.

An advantage of the present invention is that the velocity profile at the rotor wheel outlet aperture can be influenced in such a manner that a low energy flow zone does not simultaneously arise at the carrier disc and at the cover disc which would result in an unstable velocity profile which could change suddenly in a discontinuous, uncontrolled manner. The method of the invention results in the rotor wheel and/or the guide wheel and/or the centrifugal pump being formed in such a manner that an asymmetric velocity profile is produced outside the region of maximum efficiency and in particular shortly before flow separation in the guide apparatus at the rotor wheel outlet aperture which avoids the destabilizing influence of low energy zones occurring simultaneously at the carrier disc and the cover disc.

A large number of flow profiles occur in a centrifugal pump. The velocity profile preferred in the present invention lies between an inner flow line and an outer flow line of the centrifugal pump. A centrifugal pump has a rotor wheel with a center of rotation. The effective velocity of a fluid in a centrifugal pump is represented by a velocity vector which can be split up into a radial component of the velocity vector and a tangential component of the velocity vector. The radial component of the velocity vector lies in a common plane with the center of rotation of the rotor wheel and is particularly well suited for detecting low energy flow zones. A velocity profile in another direction could naturally also be suitable, for example a velocity profile which includes the entire velocity vector, i.e. both the radial and the tangential components of the velocity vector.

DESCRIPTION OF THE PREFERRED EMBODIMENTS

Figure 1:
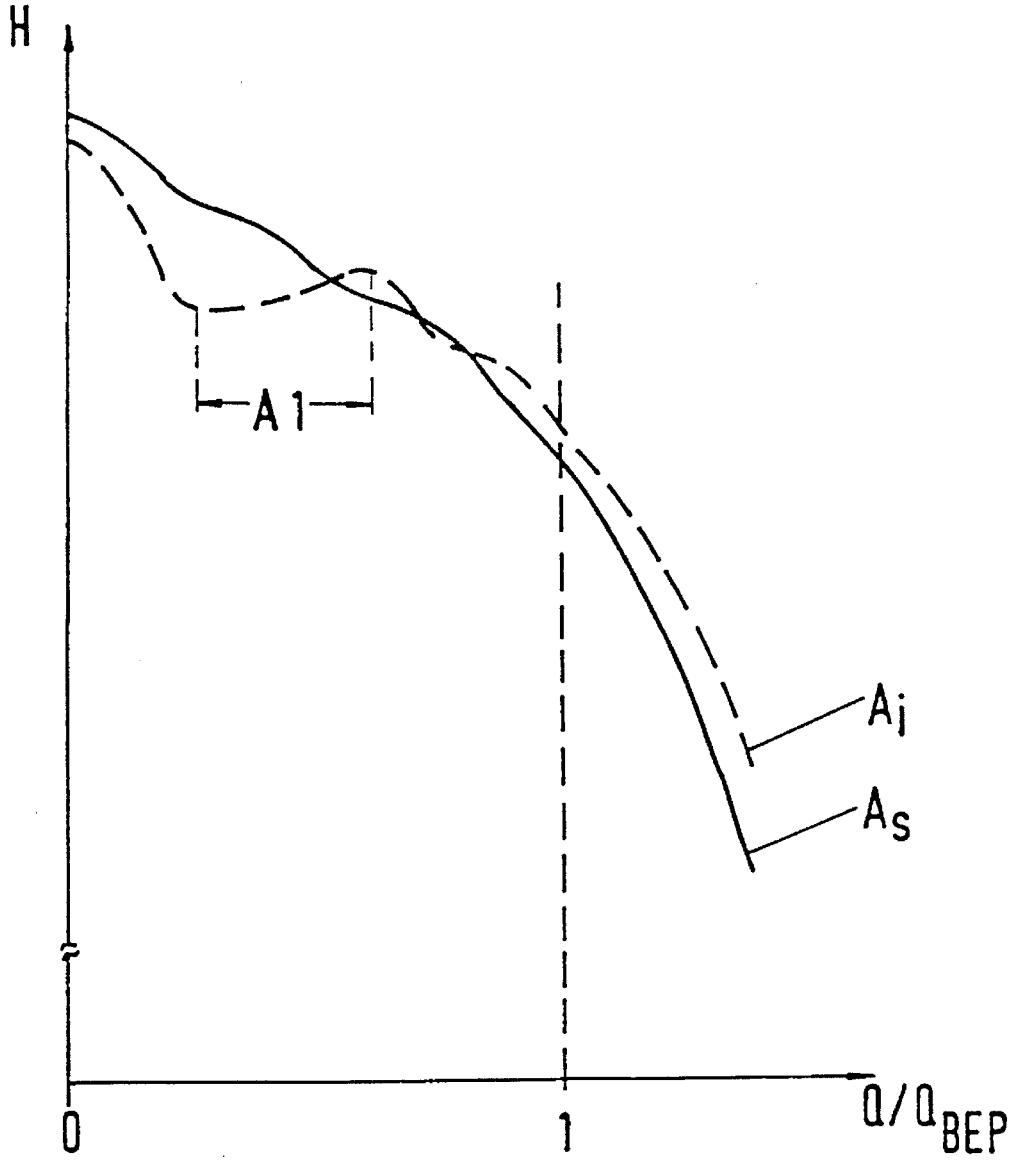
FIG. 1 is a diagram which illustrates a stable and an unstable delivery characteristic of a centrifugal pump.

FIG. 1 shows a characteristic of a centrifugal pump, namely the delivery head H as a function of the delivery flow Q, or more precisely as a function of $Q/Q_{BEP}$ which is the ratio of the delivery flow Q to the delivery flow $Q_{BEP}$ at the best point. The shape of this H(Q)-curve depends on the flow profile of the fluid in the centrifugal pump, in particular on a large number of geometrical parameters which relate to the design of the centrifugal pump. Centrifugal pumps often have an unstable H(Q)-characteristic as is shown by a second characteristic $A_i$ over the range A1.

This unstable region A1 proves to be disadvantageous when running a centrifugal pump up to speed and also when operating under part load within the unstable region, since a centrifugal pump can only be reliably operated within a stable region. The first characteristic $A_s$ shows a H(Q)-curve with a steadily falling profile which is termed a stable H(Q)-characteristic within which the centrifugal pump can be operated reliably.

Figure 3:
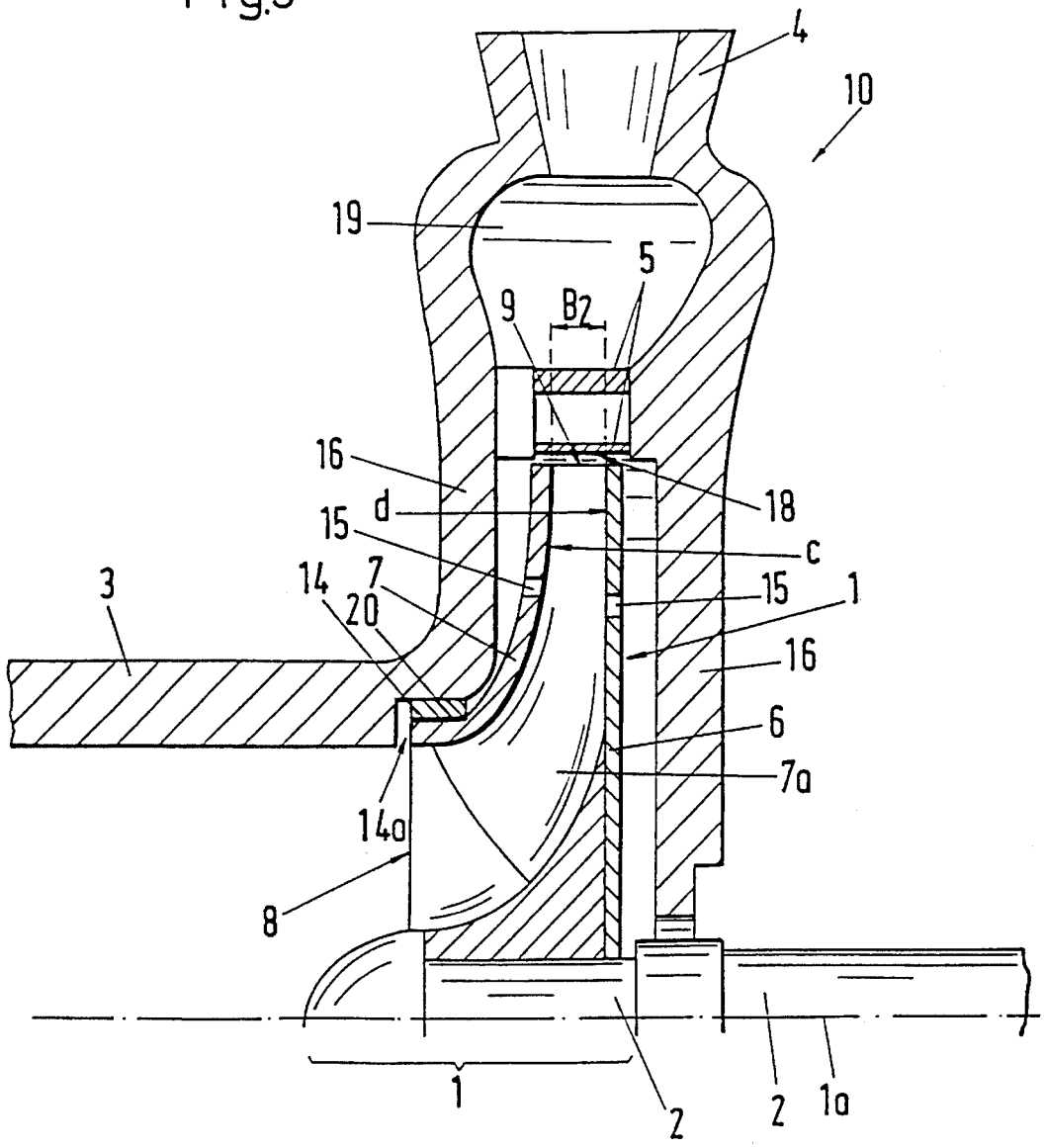
FIG. 3 is a sectional view of a radial rotor wheel with guide wheel.

FIG. 3 shows a cross-section through a centrifugal pump 10 with a radial, closed rotor wheel 1, a shaft 2, a pressure housing 16 and a guide wheel 5. The fluid flows from an intake duct 3 into a rotor wheel inlet aperture 8, through the rotor wheel 1, and enters at the rotor wheel outlet aperture 9 into the pressure duct 4 via a guide wheel 5. The closed rotor wheel 1 comprises a carrier disc 6, a cover disc 7 and also at least one blade 7a arranged between them. The present embodiment shows a guide wheel 5 with guide blades. The transition between the rotor wheel outlet aperture 9 and the spiral housing 19 or pressure duct 4 can however also be formed as a bladeless ring chamber.

Figures 2A, 2B, 2C, 2D:
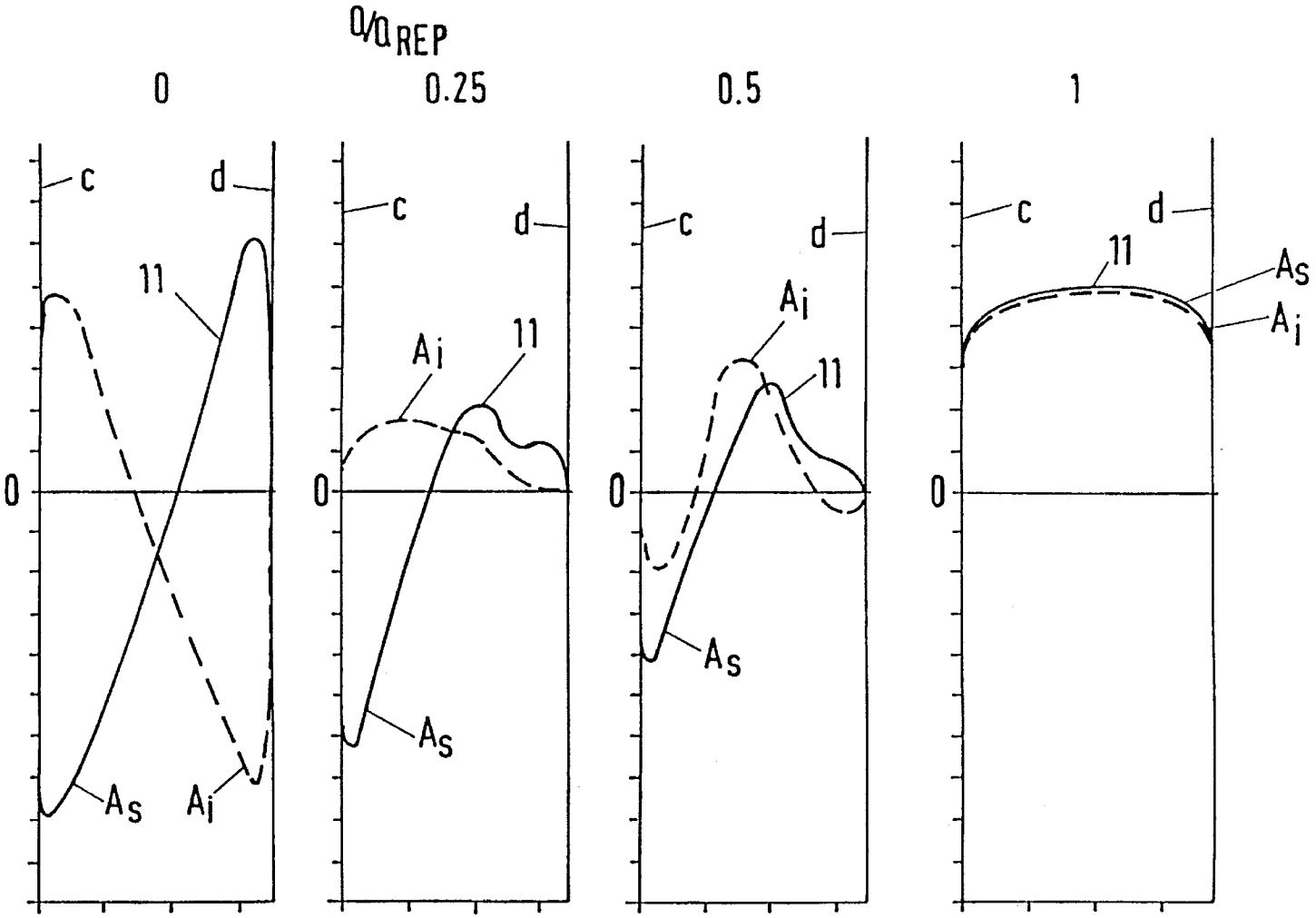
FIGS. 2*a*, 2*b*, 2*c*, 2*d* are diagrams which illustrates velocity profiles for various delivery flows.

A flow with a velocity profile 11 forms between the carrier disc 6 and the cover disc 7 when a fluid is flowing and is bounded by an inner flow line d and an outer flow line c. FIGS. 2*a*–2*d* show various velocity profiles 11 arising between the inner and outer flow lines (c, d) as a function of the delivery flow Q, or more precisely as a function of the ratio $Q/Q_{BEP}$. In the above embodiment it is assumed that the components of a rotor wheel 1 or of a centrifugal pump 10 which determine the velocity profile 11 are designed in such a way that an approximately symmetrical velocity profile exists at the design point of the centrifugal pump, i.e. at $Q/Q_{BEP}=1$, as shown in FIG. 2*d* with the profile $A_s$.

FIGS. 2*c*, 2*b* and 2*a* each show one velocity profile 11 with a stable profile A and one with an unstable profile $A_i$ with a reduced flow rate Q, with FIG. 2*a* showing a flow rate $Q/Q_{BEP}=0$. The stable profile $A_s$ changes continuously as a function of the flow rate Q, the back flow contribution increasing towards the outer flow line c. In the present patent document, a continuously changing velocity profile is to be understood as a profile with the properties that the flow direction does not change abruptly in certain regions of the velocity profile as a function of the flow rate Q, as can for instance be seen in the unstable profile $A_i$ in FIGS. 2*b* and 2*c* towards the outer flow line c, but rather that the velocity profile as a function of flow rate Q varies without an abrupt change in the flow which, in the present example, manifests itself in that the back flow contribution of the fluid for the stable profile $A_s$ steadily increases with a decreasing flow rate Q towards the outer flow line c. In contrast, the unstable profile Ai, which is representative of the flow behavior of known centrifugal pumps, shows an unstable discontinuous behavior from FIG. 2*d* to FIG. 2*a*. The unstable profile Ai of FIG. 2*c* has a back flow current at both flow lines c, d. The unstable profile Ai changes in such a way that with a further reduction of the flow rate $Q/Q_{BEP}=0.25$ of FIG. 2*b*, no more back flow current arises. On further reduction of the flow rate $Q/Q_{BEP}=0$ the flow strongly rises at the outer flow line c whereas a marked back flow arises at the inner flow line d. This abrupt change in the flow of the unstable profile $A_i$ is the reason for an unstable H(Q)-curve as shown with $A_i$ in FIG. 1.

The components of the centrifugal pump 10 which determine the velocity profile 11 of the delivery flow Q are formed in such a way in the invention that the velocity profile 11 steadily changes as the flow rate Q changes, as is shown by the stable profile As. Along with the design of the rotor wheel 1 with at least one blade 7*a*, carrier disc 6 and cover disc 7, further components can also be correspondingly provided such as the rotor wheel inlet 8 and the rotor wheel outlet 9, and also components fitted in front of or behind the rotor wheel 1 such as a guide wheel 5. The velocity profile 11 can be influenced by further measures such as by apertures 15 provided in the rotor wheel 1 through which liquid flows, or through a design of the inlet flow gap 14*a* of such a kind that liquid flows out of the gap 14 so that the velocity profile 11 is influenced, particularly in the region of the rotor wheel inlet 8.

The design of the components of the rotor wheel 1 or of the centrifugal pump 10 determining the velocity profile 11 of the conveying flow Q between the inner and outer flow lines c, d allows many design options for the implementation. However, a person skilled in the art knows how to design the components so that a steadily changing velocity profile 11 is achieved. For instance, a person skilled in the art uses numerical calculation methods in order to select components appropriate for a desired specification. The rotor wheel 1 has a center of rotation la. The velocity profile shown in FIGS. 2*a* to 2*d* lies between the inner and outer flow lines c and d and in a common plane with the center of rotation la and therefore includes the radial components of the velocity vector.

The rotor wheel and, if provided, also the guide apparatus are designed in such a way that a steady development of the velocity profile 11 as a function of the delivery flow Q results, in particular at the rotor wheel inlet 8 and at the rotor wheel outlet 9. In the embodiment shown in FIGS. 2*a* to 2*d*, a low energy flow zone at the outer flow line c is avoided in order to avoid destabilizing flow discontinuities, in particular for half-axial or axial centrifugal pumps. Moreover, the rotor wheel 1 and the guide apparatus 5 can be designed in such a manner that flow separation in the guide apparatus does not take place in the region where the characteristic of the static pressure at the rotor wheel outlet is flat or unstable.

The shape of the rotor wheel and the guide apparatus is made such that an asymmetric velocity profile is produced at the rotor wheel outlet 9 shortly before a flow separation in the guide apparatus to avoid the destabilizing influence of low energy flow zones appearing simultaneously at the inner and outer flow lines c, d. This is also important for the stability of the characteristics for pumps with twin-flow rotor wheels as these usually have a symmetrical design and thus, by reason of that geometry, produce a symmetrical velocity profile. A closed rotor wheel is shown in FIG. 3. For half-open or open rotor wheels, the outer and inner flow lines c, d would partly follow or be attached to the housing 16.

Figure 4:
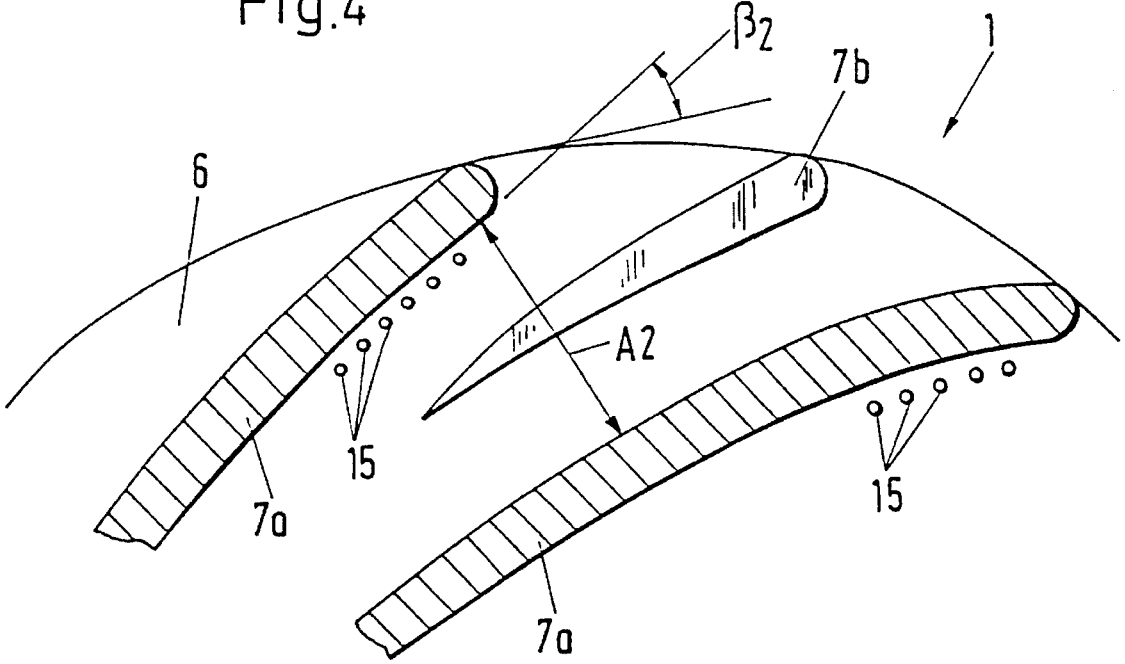
FIG. 4 is a plan view of a carrier disc of a rotor wheel.

FIG. 4 shows a plan view onto a carrier disc 6 of a rotor wheel 1 with blades 7*a*. The velocity profile 11 can be determined by, amongst other things, the blade arrangement, for example by the blade separation A2, and/or the blade outlet angle beta2 and/or the angular profile of the blade 7*a* and/or the rotor wheel outlet width B2. Apertures 15 can be seen which are arranged in such a manner that the velocity profile 11 is changed in a specific manner, for example by arranging the apertures or perforations 15 in a low energy flow zone.

Figure 5:
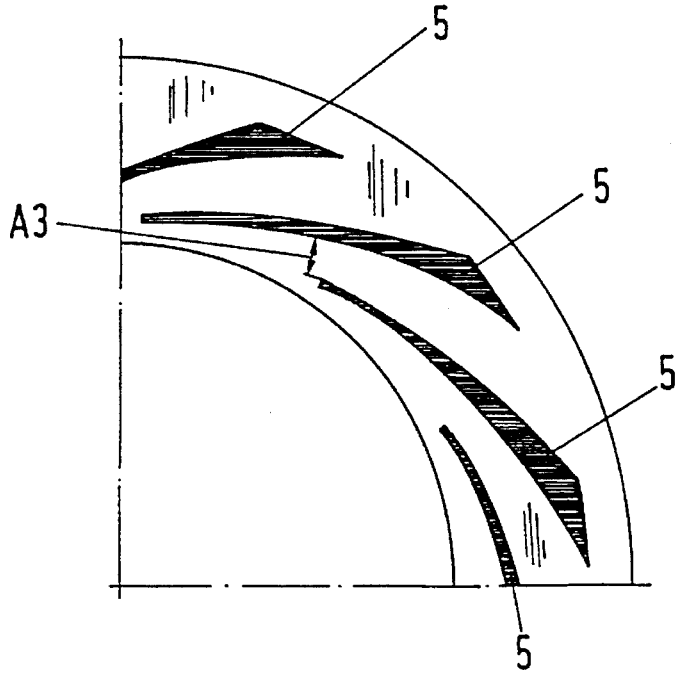
FIG. 5 is a plan view of a guide device.

FIG. 5 shows a plan view onto a guide device with a guide wheel 5, wherein the choice of the inlet width A3 of the guide wheel 5 also affects the velocity profile 11.

Figure 6:
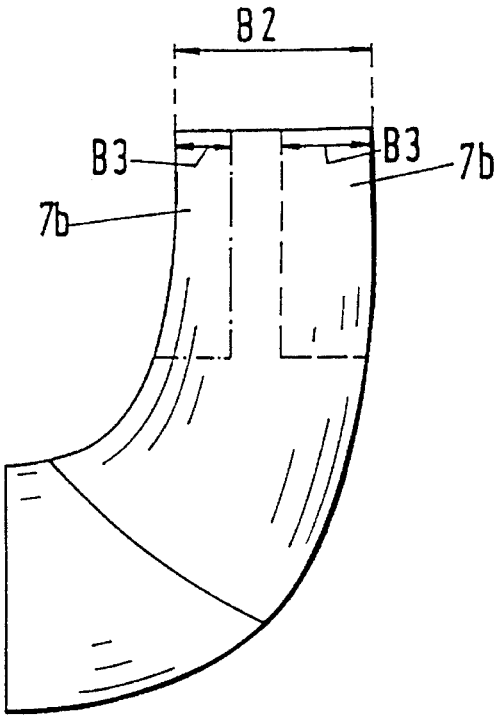
FIG. 6 illustrates the arrangement of an intermediate blade in a rotor wheel.

As shown in FIG. 6, intermediate blades 7*b* can also be arranged in the rotor wheel 1 which extend over a part of the width B3 of the rotor wheel outlet width B2 in order to influence the flow of the fluid.

Figure 7:
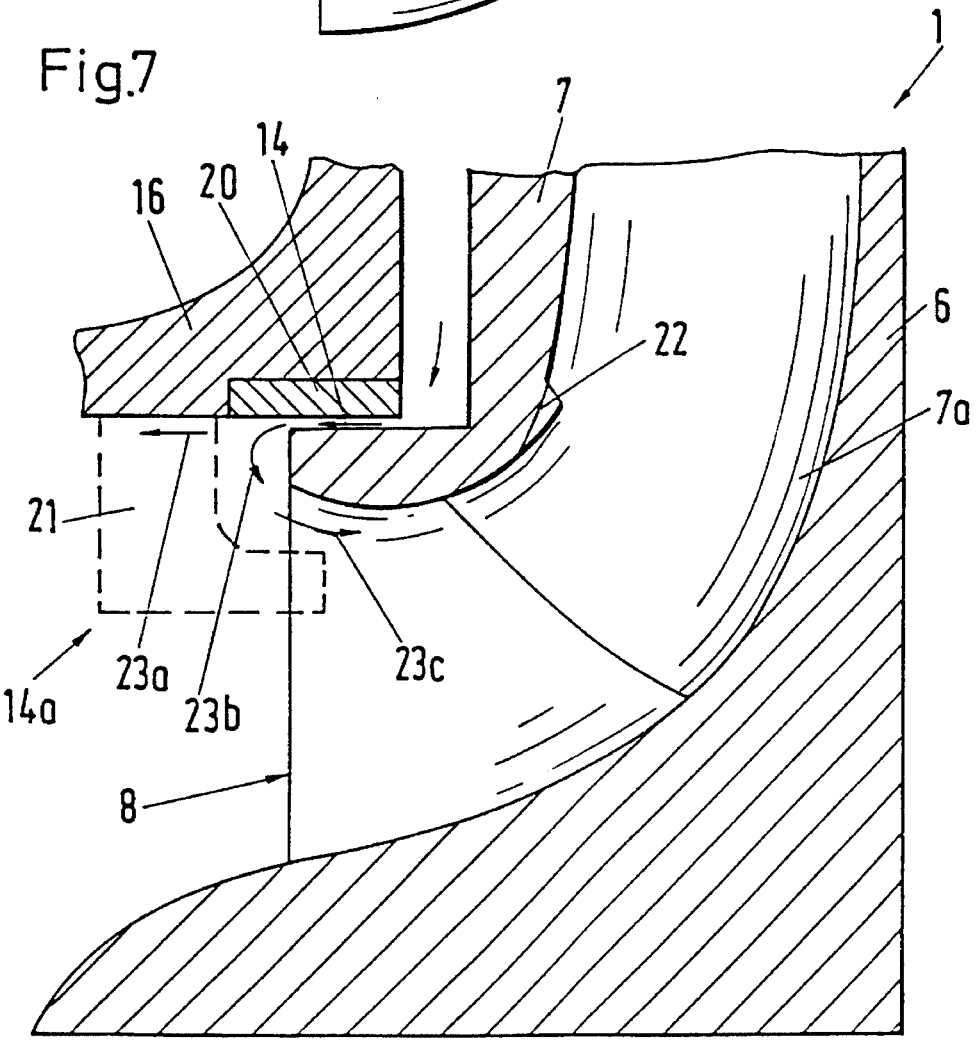
FIG. 7 illustrates various designs of a gap.

FIG. 7 shows a gap 14 of a centrifugal pump 10 with a fluid flow 23*a*, 23*b*, 23*c* emerging from between the rotor wheel 1 and the housing 16 or a sealing ring 20. The flow direction of the emergent fluid flow can be influenced with a guide element 21 so that, depending on what is required, a fluid flow 23*a*, 23*b*, 23*c* in different flow directions is produced in order to thereby influence the velocity profile 11. A trip edge 22 clan be used to influence the velocity profile 11 and, in the present embodiment, is arranged at the outer flow line c of the rotor wheel 1.

Further examples of possibilities for influencing the velocity profile 11 can for example be achieved by the following measures:

The components of the centrifugal pump which determine the flow behavior are specifically designed so that, for an axial or half-axial centrifugal pump, a high energy zone is produced at the outer flow line c.

The twist of the blade 7*a* in half-axial or axial rotor wheels is designed in such a way that flow separation at the hub takes place before a low energy zone arises at the outer flow line c.

The relationship between the blade length and blade pitch is selected for half-axial or axial rotor wheels such that a low energy zone at the outer flow line c is avoided.

The inlet width A3 of the guide wheel 5 is varied in its width between the outer flow line c and the inner flow line d in order to effect an asymmetric velocity profile 11.

The inlet opening 18 of the guide wheel 5 and the rotor wheel outlet opening 9 are offset relative to one another in a direction axial to the shaft 2.

The components of the centrifugal pump which determine the flow behavior are specifically designed so that flow separation occurs in the guide wheel 5 before the gap characteristic becomes flat or unstable.

The blade separation A2 at the rotor wheel outlet is varied[ in its width between the inner flow line d and the outer flow line c in order to produce an asymmetric velocity profile.

What is claimed is:

1. A method of configuring a rotordynamic pump which, in operation, has a stable HQ curve with a negative gradient at fluid flow rates below an optimal flow rate, the pump including an impeller defining an inlet and an outlet and spaced-apart surfaces which guide the fluid as it flows between the inlet to the outlet, the method comprising the steps of determining a velocity profile for the fluid comprising flow rates and flow directionality for the fluid flowing between the surfaces, and shaping components of the pump which come into contact with the fluid flowing through the pump so that abrupt changes in the velocity profile are prevented over the range of flow rates to which the pump will be exposed in use, whereby the formation of a positive gradient or a flat portion in the HQ curve is prevented and a stable HQ curve for the pump with a negative gradient only is attained.

2. A method according to claim 1 including determining a velocity profile at the impeller outlet, and wherein the step of shaping includes taking the velocity profile at the impeller outlet into consideration.

3. A method according to claim 1 including determining a meridional velocity component of the fluid flow between at least a portion of the spaced-apart surfaces, and wherein the step of shaping includes taking the meridional velocity component into consideration.

4. A method according to claim 1 wherein the step of shaping the components of the pump which come in contact with the fluid flowing through the pump is conducted in such a way, that, at fluid flow rates below the optimal flow rate, the velocity profile has a nonuniform, asymmetric shape, and that a nonuniform, assymetric shape of the velocity profile increases continuously as the flow rate is reduced.

5. A method according to claim 4 wherein the step of shaping is further conducted in such a way that the velocity profile has at least one of a zone of a relatively low fluid flow rate and a zone in which the fluid flow reverses direction, and that the zones do not change positions relative to the spaced-apart surfaces when the fluid flow rate changes.

6. A method according to claim 1 wherein the step of shaping is conducted in such a way that a zone is formed in the fluid flow proximate a first one of the spaced-apart surfaces which has a speed which is relatively lower than a speed of a remainder of the fluid flow when the fluid flow rate is below the optimal flow rate to thereby form an asymmetric velocity profile.

7. A method according to claim 6 wherein the step of shaping is further conducted in such a way that the speed of the fluid flow proximate a second one of the spaced-apart surfaces is relatively higher than the remainder of the fluid flow when the fluid flow rate is below the optimal flow rate.

8. A method according to claim 1 wherein the step of shaping is conducted in such a way that the fluid flow rate proximate one of the spaced-apart surfaces becomes relatively larger than the fluid flow rate proximate another one of the spaced-apart surfaces when the fluid flow rate through the pump is changed.

9. A method according to claim 1 wherein the pump includes blades between the spaced-apart surfaces, and including the step of influencing the velocity profile by changing at least one of a separation between the blades, an outlet angle of the blades, an angular profile of the blades, and a width of the impeller outlet.

10. A method according to claim 1 wherein the step of shaping includes the step of providing a recirculation path from the impeller outlet to the impeller inlet to therewith influence the velocity profile.

11. A method according to claim 10 wherein the step of providing the recirculation includes locating the path outside a flow path defined by the spaced-apart surfaces.

12. A method according to claim 1 wherein the step of shaping includes the step of forming a plurality of apertures extending past at least one of the spaced-apart surfaces and transversely to the fluid flow between the spaced-apart surfaces to therewith influence the velocity profile.

13. A method according to claim 12 wherein the step of shaping is conducted in such a way that a zone of relatively lower fluid flow rate is formed proximate one of the spaced-apart surfaces, and including the step of positioning the apertures at the zone of relatively lower fluid flow rate.

14. A method according to claim 1 wherein the step of shaping includes the step of forming a tip edge which is contiguous with a selected one of the spaced-apart surfaces.

15. A method according to claim 1 wherein the impeller includes a plurality of spaced-apart blades disposed between the spaced-apart surfaces, and wherein the step of shaping includes the step of positioning at least one intermediate blade between the blades which extends between the spaced-apart surfaces over a lesser distance than the plurality of blades.

16. A method according to claim 1 wherein the step of shaping includes positioning a guide wheel about a periphery of the impeller for directing the fluid flow from the outlet of the impeller to an outlet of the pump, and providing the guide wheel with an inlet width proximate the outlet of the impeller which varies from a point proximate one of the spaced-apart surfaces of the impeller and another one of the spaced-apart surfaces to establish an asymmetric velocity profile.

17. A method according to claim 16 wherein the impeller rotates about an axis of rotation, and including displacing the inlet of the guide wheel relative to the outlet of the impeller in the direction of the axis of rotation.

18. A method according to claim 1 wherein the impeller comprises a twin-flow impeller defined by first and second impeller sections, and including shaping the impeller sections asymmetrically.

* * * * *